United States Patent [19]

Manzke

[11] Patent Number: 4,903,955

[45] Date of Patent: Feb. 27, 1990

[54] DOCUMENT STACKING APPARATUS

[75] Inventor: G. William Manzke, Quakertown, Pa.

[73] Assignee: Bell & Howell Phillipsburg Company, Allentown, Pa.

[21] Appl. No.: 248,457

[22] Filed: Sep. 23, 1988

[51] Int. Cl.[4] ..... B65H 29/42

[52] U.S. Cl. ..... 271/176; 271/179

[58] Field of Search ..... 271/179, 176, 189, 192

[56] References Cited

U.S. PATENT DOCUMENTS

| | | | |
|---|---|---|---|
| 277,806 | 5/1883 | Stonemetz et al. | 271/179 |
| 2,778,638 | 1/1957 | Whillock | 271/179 |
| 3,712,487 | 1/1973 | Eberle | 271/179 X |

*Primary Examiner*—Richard A. Schacher

[57] ABSTRACT

Apparatus and method for stacking a plurality of documents on one edge thereof. The apparatus comprises a motor-driven revolving hollow helix device into which fed documents are individually injected substantially transversely to the helix axis between consecutive helix turns. A single-revolution clutch device between the motor and the helix device provides indexed rotation (orientation) of the helix device for receiving and transporting injected documents. Operation of the clutch device is controlled by a photo-sensor that is located at the exit of the document feed section and that senses injection of each document into the helix device. Injected document feed motion is stopped by a stationary abutment stop. The revolving helix device transports injected documents by screw-action in direction of its axis and stacks the documents side-on-side as they are transported beyond the face of the helix device. Anti-rotation guards that are adjustable to different document sizes are disposed in the region of the helix device to prevent undesirable rotation of injected documents as a consequence of frictional engagement of documents with the revolving helix device. A belt of a driven belt-/pulley arrangement of the document feed section is located in a region to assist the stacking operation by frictionally engaging and driving one edge of one or more of the last-stacked documents, and thusly assists document propulsion onto the stack.

7 Claims, 4 Drawing Sheets

DOCUMENT STACKING APPARATUS

BACKGROUND OF THE INVENTION

1. Field of the Invention:

This invention relates to apparatus and method for handling flat articles such as documents, envelopes, cards and the like, and more particularly to apparatus and method for receiving documents individually sequentially edge-on at a high celerity and stacking the documents adjacently side-on-side.

2. Prior Art and other Considerations:

Machines for automatically handling documents such as mailing envelopes at high celerities find increasingly widespread use in commercial and governmental institutions. Among such machines are those that are adapted to receive documents which are singly delivered thereto at a high velocity and that stack the documents side-on-side so that they are orderly arranged in a stack.

Problems are often encountered in automatically stacking documents at high speeds. For example, rapid accelerations and decelerations, together with various frictional effects encountered in the course of the transition from sequential feed to the stacking mechanisms while the documents are being variously engaged and disengaged, can cause binding or buckling and can damage documents. Moreover, misalignment during stacking may cause damage to the documents. For instance, if side-on-side sliding of envelopes occurs during stacking, envelopes can become torn. Window-type mailing envelopes are particularly susceptible to tearing near the window, which not only damages the envelope itself, but may also cause jamming in the stacking apparatus, possibly necessitating shut-down of the device.

Prior art stacking devices employing helical or screw-type device for the transfer of individually sequentially fed articles into stacks are known. For instance, U.S. Pat. No. 277,806 to Stonemetz et al shows a packing device that comprises a revolving helix device that receives papers, envelopes and the like edgewise between the coils of its helix and conveys these, as it revolves, broadsidewise to a bench.

U.S. Pat. No. 3,160,293 to Hennequin discloses a rotatable circular disc with a cut-out that has one sidewall warped out of the plane of the disc so as to provide a vane. The vane is in the general form of a portion of a helicoid projecting from the side of the disc against which each elementary stack of letters is to be formed.

Another prior art stacking device shown in U.S. Pat. No. 4,378,938 to Staniszewski discloses a mechanism using counter-rotating helical stacker members. U.S. Pat. Nos. 3,280,679 (Huffman), 3,847,382 (McKee), and 3,995,851 (Casper) also show screw-like devices for handling, engagement, or transporting of documents.

U.S. patent application Ser. No. 07/109,058, entitled Document Stacking Apparatus and commonly assigned herewith, is incorporated herein by reference as disclosing an apparatus wherein upper and lower rotatable stacking screw worms move documents laterally away from a carriage into stacked relationship. Sensing means such as an electric contact switch or a photoelectric cell can be used to detect horizontal movement of the stacking apparatus.

In view of the foregoing, it is an object of the present invention to provide apparatus and method for automatically stacking documents at high celerities.

An advantage of the present invention is the provision of apparatus and method for automatically stacking documents at high celerities that avoids side-on-side sliding of documents and jamming of the device.

A further advantage of the present invention is the provision of improved apparatus and method for automatically stacking documents at high celerities that utilizes a helix device having non-uniform leads for stacking and provides for substantial independence of operation of the helix device in respect to interdocumental pressure variations in the stack.

Another advantage of the present invention is the provision of document stacking apparatus that utilizes drive components of the document feeding device to facilitate and assist reliable and orderly document stacking.

Yet another advantage of the present invention is the provision of improved apparatus and method for automatically stacking documents at high celerities that utilizes a helix device that is automatically clutched for one revolution at a time in dependence on and under control of the sensing of injection of a document.

Yet a further advantage of the present invention is the provision of improved apparatus and method for automatically stacking documents at high celerities that utilizes a document feeding section that is adjustable to feeding different sizes of documents and a document stacking apparatus section that is adjustable to receiving, stacking, and accumulating such different sizes of documents.

Another advantage of the present invention is the provision of a document feeding section including photosensors and associated control circuitry for automatic document jam detection therein.

SUMMARY OF THE INVENTION

The document stacking apparatus of the invention receives documents individually and sequentially fed edge-on at high celerities, and forms a stack with the documents arranged adjacently side-on-side. The stacker of this invention can be used to form a document stack in a stationary bin or on a stationary platform or on a transport raceway, such as a conveyor, whereby the stacks as formed can be transported away from the stacking operation in a continuous or discontinuous (batch) manner for further handling as required. The stacker of the invention is admirably suited for use with high speed feeding devices which feed individual documents seriatim more or less in free flight at high celerities, such as required in mail sorting and mail inserter machines.

The present invention provides an apparatus for stacking a plurality of documents and comprises a document feeding section, a stacking portion, and a stack accumulator portion. The document feeding section feeds documents individually seriatim edge-on at high speeds (in the plane of the document) to the stacking portion. The latter receives each such document, stops its feed motion, and imposes a new motion that is directed substantially at a right angle to its feed motion by use of a helix device which revolves about its axis, being driven by a motor. A single-revolution clutch device between the drive motor and the helix device provides indexed rotation of the helix device. The clutch device is automatically actuated for one revolution of the helix device at a time in dependence on and under control of the sensing (by a photo-sensor) of a fed document that is injected transversely into the helix device between consecutive helix turns.

The helix device is provided with non-uniform leads such that spacing between adjacent coils become smaller toward the end of the helix facing the stack. Whereas such spacing is desired to be large at the document injection site, for good mechanical advantage of document stacking by the helix action, a small lead angle at the end of the helix that faces the stack is best.

The stack accumulator may be a table or supporting surface provided with appropriate guide arrangements to hold and to allow an accumulating stack to slide on and along it while keeping the stack in orderly alignment. The stack backs onto a slideable carriage that is adapted for appropriately loaded movement to provide adequate stack compression as it increases in depth. The carriage arrangement may also be adapted to allow continuous or discontinuous removal of individual documents or portions of the stack from its end that backs onto the carriage for further document transport and handling without the need for stopping the operation of the apparatus.

The base or supporting surface of the stack accumulator is provided with low-friction facings to effect low-force sliding of documents being stacked upon it. Alternately, the base or supporting surface of the accumulator is equipped with a free-running endless conveyor belt to facilitate movement of the accumulating stack along it as the stack increases in depth.

A portion of a belt of a driven belt/pulley arrangement of the document feeding section is located in a region to assist the stacking operation of the helix device by frictionally engaging and driving one edge of one or more of the last-stacked documents, thusly assisting document propulsion onto the stack. This assisting belt portion engages the rearmost-arriving and proximate edge of one or more of the last-stacked documents in a manner permitting partial relative slippage between the contacting edges of the documents and the resilient belt surface turning about and moving between pulleys. The pulley and belt (of the document feeding section) located on the side closer to the accumulating document stack is used for this purpose.

The entire apparatus, including the document feeding section is adjustable to handle different sizes of documents by appropriate lateral adjustment of location of the entry to the document feeding section, by appropriate lateral adjustment of the location of the helix device including its drive and motor together with the location of its document stop abutment location and other associated components, and by respective lateral adjustment of an alignment side-wall along the carriage of the stack accumulator portion.

The document feeding section includes photosensors and associated control circuitry for automatic document jam detection therein.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

The stacking apparatus of the present invention will be described in conjunction with a document feed device. The feed device feeds documents to the stacking apparatus individually sequentially edge-on at high celerities. The document stack is formed on a stack accumulating raceway whose surface is provided with low-friction facings to effect low-force sliding of the formed stack away from the stacking portion of the apparatus. Alternately, the raceway of the accumulator is provided with a free-running endless conveyor belt to facilitate movement of the accumulating stack along it as the stack increases in depth. In use of the free-running belt, movement of the documents in the stack in unison is promoted.

Figure 1:
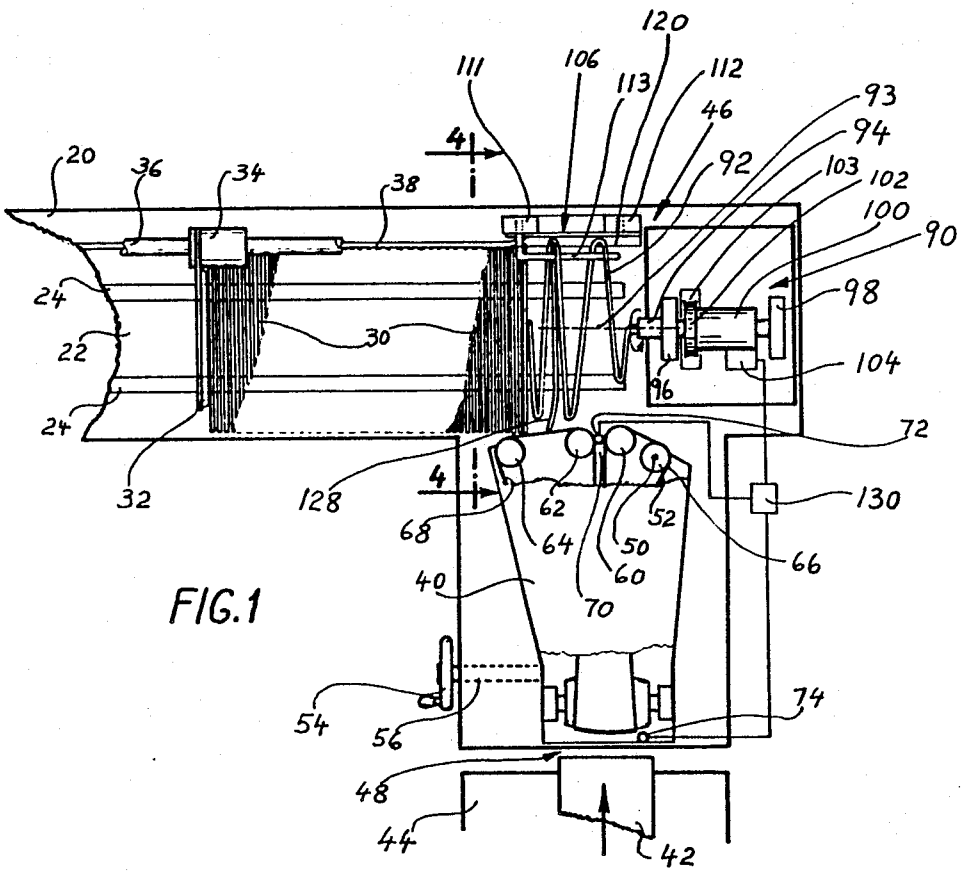
FIG. 1 is a schematic plan view of a document stacking apparatus according to an embodiment of the present invention, also showing a portion of means for feeding documents to the apparatus and a portion of a document stack accumulator and carriage.
Figure 2A:
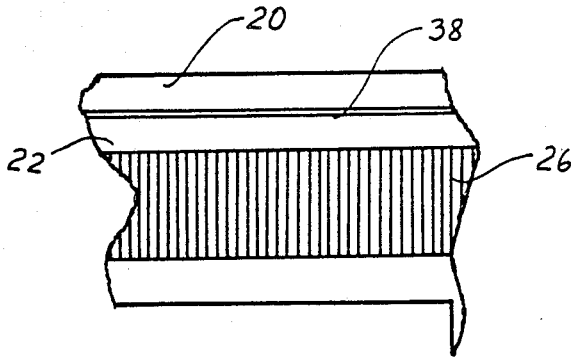
FIG. 2A is a schematic fragmental plan view of a portion of the apparatus, showing a portion of a carriage of a document stack accumulator, according to another embodiment of the present invention.
Figure 2B:
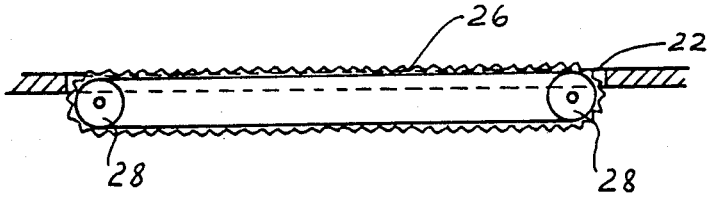
FIG. 2B is a schematic fragmental side elevational view of the portion of the apparatus of FIG. 2A.

Referring now to the drawings, numeral 20 designates a frame base on which the stacking apparatus and its components are supported and mounted. A raceway 22 on which the stack is formed is provided with low-friction facings 24 on its surface, for example in form of thin Teflon strips that are affixed to the surface, as indicated in FIG. 1. Alternately, as shown in FIGS. 2A and 2B, raceway 22 is equipped with a free-running (endless conveyor) belt 26 which is arranged such that its upper surface is slightly above the surface of base 20. Free-running belt 26 is guided by appropriate pulleys 28 that are borne within frame base 20. Belt 26 may be provided with transverse serrations. Stacked documents in document stack 30 are supported edge-on on the low-friction facings 24 or, alternately, they are supported edge-on on free-running belt 26.

Document stack 30 (FIG. 1) backs onto a movable carriage plate 32 that is attached to and guided in conventional manner by a friction bushing 34 which slides along rail 36. Rail 36 is supported by conventional arrangements at its ends on frame base 20 (arrangement not shown here). Carriage plate 32 is free to move along rail 36 with adjustable friction (in bushing 34) such as to securely retain document stack 30 in its stacked form as it is being accumulated. Carriage plate 32 with its bushing 34 is also freely pivotable about rail 32 and may thusly be lifted up out of the way of document stack 30.

Carriage plate 32 rests with its lower edge on and slides along raceway facings 24. Alternately, carriage plate 32 rests with its lower edge on belt 26, when the latter arrangement is used. Document stack 30 is guided and constrained on one side from lateral movement along a guide plate 38.

A document feeding means 40 is shown in FIG. 1 in partial fragmented representation. The document feeding means 40 receives documents oriented in a horizontal plane, as indicated by document 42, transports the documents between adjacent belts while reorienting them by substantially 90 degrees into an appropriate vertical plane, and feeds or injects the documents thusly edge-on to a stacking portion 46 of the document stacking apparatus. Documents are received for entry to document feeding means 40 from document handler 44 that is indicted in FIG. 1 by a partial outline only and that may be any appropriate document handling and processing apparatus.

Document feeding means 40 is generally of a conventional type and, therefore, will not be further discussed here except with regard to those additional aspects which are provided to facilitate and promote operation in conjunction with the document stacking apparatus of the present invention. Document feeding devices that provide 90 degree or 180 degree turn-over of documents through use of twisted conveyor belt drives during feeding are conventionally known. For instance, U.S. Pat. No. 4,226,324 to Stocker discloses an article turnover assembly using twisted belt drives.

Document feeding means 40 is pivotably mounted upon frame base 10 of the document stacking apparatus to provide lateral adjustment of its entry region 48. The purpose for such adjustment is to adapt operation to different sizes of documents. Generally, documents are handled and delivered from document processing devices having one of the documents' lateral edges in particular positional alignment registration relative to the document processing device. Unless the registration position is on the same side and in the same position for document handler 44 as it is for document feeding means 40 (at its entry region 48), serious alignment problems arise. Therefore, entry region 48 of document feeding means 40 is made to be laterally adjustable. This is accomplished by pivotable mounting of the entire document feeding means 40 (including its drive motor), whereby the vertical pivot axis 50 is preferably located to coincide with the axis of driving pulley 52. An appropriate adjusting mechanism, for example in form of a conventional screw and floating nut arrangement may be utilized (not shown). Handwheel 54 serves to rotate screw-shaft 56 and thereby provides the described lateral adjustment of document feeding means 40.

Figure 3:
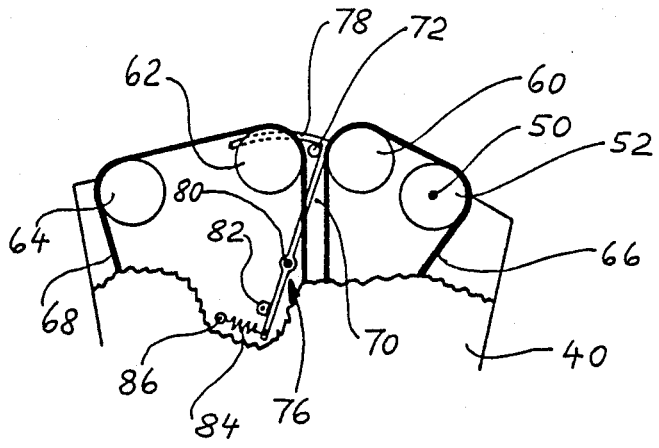
FIG. 3 is an enlarged schematic fragmental plan view of a portion of the apparatus of FIG. 1, namely a portion of means for feeding documents to the apparatus, showing additional detail.

As shown in FIGS. 1 and 3, document feeding means 40, in the region of its delivery end, comprises a right exit pulley 60, a left exit pulley 62, and a left assist pulley 64. Endless belts are carried about these pulleys, namely right belt 66 about pulleys 52 and 60 and left belt 68 about pulleys 62 and 64. A delivery region 70 is indicated as the space between belts 66 and 68 in the proximity of and between pulleys 60 and 62. It should be noted that region 70 is shown here wider than it actually is for the sake of clarity of description. It will be understood that the width of region 70 is such as to securely grip conveyed documents between belts 66 and 68.

A photo-sensor, namely delivery sensor 72, is disposed at the exit of delivery region 70 for detection of document delivery. Another photo-sensor, namely entry sensor 74, is disposed in entry region 48 to detect document entry into document feeding means 40.

An anti-back-up device 76 (shown in FIG. 3) is provided to reach into delivery region 70 and is disposed below pulleys 60 and 62 in the transport path of documents being delivered from document feeding means 40. Anti-back-up device 76 comprises an L-shaped catch 78 that is mounted pivotably about catch pivot 80. Catch 78 is spring loaded by tension spring 84 against catch stop 82. Spring 84 is anchored on anchor 86. Catch 78 is pivotably deflected by a document passing by and through delivery region 72. Once the document has passed by catch 78, catch 78 snaps back into its shown position against stop 82 and thusly prevents back up of document into the nip region between belts 66 and 68 (carried about pulleys 60 and 62, respectively). Alternatively, the anti-back-up device can be a simple spring steel piece anchored at its lower end in FIG. 3 and without any other pivot.

Stacking portion 46 comprises a helix drive assembly 90 and and side plate assembly 106, both being adjustably mounted on frame base 20. Helix drive assembly 90 comprises a helix device 92 that intermittently rotatable about a helix axis 93 and that is mounted on rotatable axle 94. Helix device 92 is formed from suitably strong material (such as, for instance, steel wire of appropriate cross-section to provide adequate strength) while offering a certain resilience to allow minor compression in operation in order to resiliently exert stacking pressure. Helix device 92 spans approximately 2 to 4 turns, although fewer or more turns may be provided without adversely affecting its operation. Helix device 92 may have uniform distance between coils. In a preferred embodiment though, helix device 92 is provided with non-uniform leads such that spacing between consecutive coils becomes smaller toward the end facing document stack 30. Inter-coil spacing is advantageously large at the document injection site, whereas a small lead angle is desirable at he end of the helix that faces stack 30 for good mechanical advantage of documents stacking by the helix action.

Axle 94 includes a clutch 100 and a clutch pulley 102, and the combination is borne by first and second supports 96 and 98, respectively, upon an assembly frame 99. Not shown here is a drive motor that is disposed below assembly frame 99 and that drives clutch pulley 102 via a belt 103 in continuous manner during operation of the apparatus. A clutch solenoid 104 is assembled to clutch 100 for activation of the clutch mechanism. Clutch 100 is driven via clutch pulley 102 and belt 103 by the drive motor and facilitates the drive's engagement to, respectively disengagement from axle 94 (and therewith helix device 92). The clutch mechanism is activated by clutch solenoid 104 under control of document detection signals from delivery sensor 72 in a manner that will be further described hereinafter.

Clutch 100 (together with clutch solenoid 104) is a conventional wrapped-spring, single-revolution clutch unit that is commercially available. For example, the PSI Division of the Warner Manufacturing Company, New Jersey, sells a suitable clutch ("CB-Series Single Revolution Clutch") that is used in the described embodiment of the invention.

Side plate assembly 106 comprises a substantially vertical plate that is adjustably mounted on frame base 20 and that has a recessed area disposed a small distance above frame base 20 to accommodate and clear the periphery of helix device 92. Side plate assembly 106 further comprises first and second mounting blocks 111 and 112 for adjustably mounting of first and second anti-rotation stops 113 and 114 respectively. Although side plate assembly 106 is shown in FIG. 1 (having second anti-rotation stop 114 removed), FIGS. 4 and 5 provide additional clarifying details.

Figure 4:
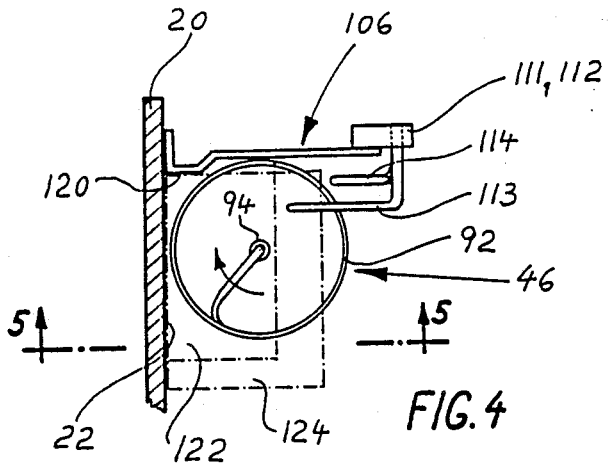
FIG. 4 is a partial sectional view of a portion of the document stack accumulator shown in FIG. 1 taken along section line 4—4 indicated therein, and providing additional detail.
Figure 5:
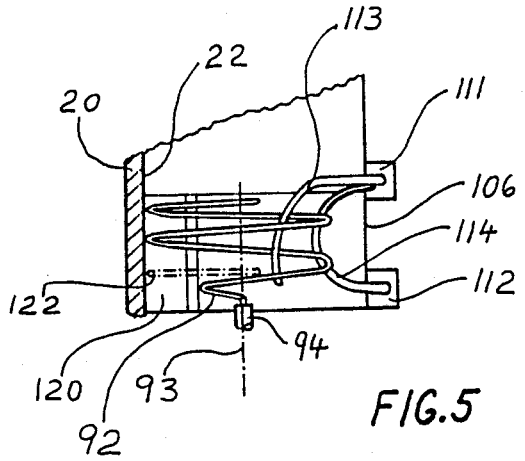
FIG. 5 is a partial sectional view of the portion of the apparatus shown in FIG. 4, taken along section line 5—5 therein.

As indicated in FIG. 1 and shown in more detail in FIGS. 4 and 5, side plate assembly 106 is further provided (along its horizontal length in proximity to the horizontal upper surface of frame base 20) with a generally vertical surface that serves as an abutment stop 120. Documents delivered and injected into helix device 92 are stopped by abutment stop 120. This is indicated by phantom outlines for a smaller document 122 (and for an alternate situation of a larger document 124).

As particularly apparent from FIG. 4 and indicated therein by an arrow, helix device 92 revolves clockwise. In order to assure that injected documents are not rotated by helix device 92 (and thereby lifted upward in the vicinity of abutment stop 120, first and second anti-rotation stops 113 and 114 are adjustably disposed such as to intercept the upper edge of an injected document (while engaged between coils of helix device 92) and thusly prevent such undesirable rotation. First anti-rotation stop 113 serves this function in regard to smaller documents and second anti-rotation stop 114 serves this function in regard to larger documents. Although both stops 113 and 114 are shown installed in FIG. 4, only stop 113 need be installed when smaller documents (as indicated by document 122) are handled. When larger documents are handled (as indicated by document 124), first anti-rotation stop 113 must be removed or adjusted out of the way of the document path and the helix device 92.

Anti-rotation stops 113 and 114 are arcuately shaped rods and are adjustably pivotally mounted at one end in mounting blocks 111 and 112, respectively, in such a manner as to permit rotational adjustment of orientation about their pivotal mounting. Once adjusted, anti-rotation stop 113 or 114 is rigidly fastened in position and orientation within respective block 111 or 112 by conventional arrangements, for instance screws. First anti-rotation stop 113 reaches into hollow of helix device 92 and, by adjustment about its pivotal mounting, is adjusted for handling of particular smaller document sizes such as to just clear the upper edge of injected documents. Second anti-rotation stop 114 is pivotally adjusted with its arcuate portion beyond the outer periphery of helix device 92 such as to clear upper edges of particular larger document sizes handled. Particular arcuate shapes of stops 113 and 114 are such that pivotal adjustment provides for adaptation to different document sizes by raising or lowering of interception locations with respect to upper document edges. Adjustability ranges of stops 113 and 114 overlap, such that they permit adjustment over a continuous range of document sizes from the smallest to the largest handleable by the entire apparatus. It will be recognized that anti-rotation stops may be in other shapes, for example such as to offer substantially straight and substantially horizontal rod portions for inception of upper document edges—if rotated by helix device 92. Such stops would be appropriately adjustable by up/down repositioning within appropriate mounting blocks.

Documents injected from document feeding means 40 into helix device 92 of stacking portion 46 are propelled by helix device 92 toward document stack 30. Left belt 68, as it continuously moves about left exit pulley 62 and left assist pulley 64, is disposed in such a location that it intercepts the adjacent edge of each document being stacked. FIG. 1 shows such a stacked document 128 as it is being slightly squeezed and thusly engaged and resiliently assisted along by left belt 68 for a short distance toward document stack 30. Partially sliding action occurs between belt 68 and the contacted edge of document 128.

Clutch solenoid 104 in helix drive assembly 90 is electrically interconnected with delivery sensor 72 (disposed at the exit of delivery region 70 of document feeding means 40) via an electrical control 130, as indicated in FIG. 1. Entry sensor 74 (in document feeding means 40) is also connected to control 130.

In operation, documents are received in substantially horizontal orientation individually and sequentially from document handler 44 and enter into document feeding means 40 at entry region 48. Document feeding means 40 turns documents by substantially 90 degrees and feeds or injects them edge-on in substantially vertical orientation through delivery region 70 to helix device 92. Helix device 92 is stopped from rotation at the time of injection of each document in an orientation that offers to the injected document an unobstructed region between consecutive turns, as shown in FIG. 1. The injected document is stopped by impact of a the lower portion of its leading edge onto abutment stop 120. As soon as the trailing edge of the injected document passes by delivery sensor 72, clutch 100 is actuated (by energization of clutch solenoid 104) to become engaged with continuously driven rotating clutch pulley 102, and helix device 92 revolves by substantially one turn (clutch 100 automatically disengages). This operation transports the document to a position one turn toward document stack 30. This position is indicated in FIG. 1 by document 128.

Subsequent documents are injected in the same manner into helix device 92, each being transported by helix device 92 by one turn at a time. Once thusly transported documents reach the end of the helix device 92, they are added side-on-side onto document stack 30, and stack 30 accumulates against movable carriage plate 32 upon raceway 22. Documents being stacked slide laterally initially along abutment stop 120 and, having disengaged from helix device 92, they slide along guide plate 38 that is disposed in line with stop 120. The mechanical advantage provided by helix device 92 securely stacks documents without a need for additional propulsion of the accumulating stack.

The described incremental rotation of helix device 92 via clutch 100 in 360 degree increments, appropriately phased and synchronized with the injection of each document, is achieved by the single-turn increment capability of clutch 100 (commercially available, as hereinbefore indicated) in conjunction with the control triggering of clutch solenoid 104 by the sensing of the injected document's trailing edge as it passes by delivery sensor 72. Control 130 serves to condition and provide appropriate signals.

Control 130 also receives signals from entry sensor 74 that detects entry of documents into document feeding means 40 to provide for shut-down of feeding means 40 in case a malfunction occurs therein, such as for instance given by a document jam within feeding means 40. For example, when sensor 74 senses entry of a second document before a previously entered document has been sensed by sensor 72 to have been delivered to helix device 92, control 130 causes shut-down of document feeding means 40 (as well as providing appropriate malfunction indication).

As hereinbefore described, the document stacking apparatus of the present invention comprises document feeding means and a stacking and stack accumulator portion. Documents are received at high celerities and are injected one at a time edge-on between turns of a helix. The helix is turned by one turn, once a document is injected, and is stopped to receive the next document. Rotation of the helix is under control of a sensor that detects the trailing edge of a document being injected and consequently triggers a clutch to effect a single turn of the helix to advance the document toward the accumulating document stack.

Side-on-side sliding of documents being stacked is avoided by the apparatus and stack accumulating is achieved by the action of the helix alone without need for additional propulsion. Stacking action is assisted by drive components of a document feeding device. The apparatus is adjustable to handling of different sizes of documents. Detection of and automatic shut-down due to malfunctions and document jams in the document feeding device is provided through photoelectric sensors that detect document passage in appropriate locations.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A mailing machine including apparatus for stacking a plurality of on-edge documents side-by-side on one edge thereof, said apparatus comprising:

means for feeding documents on-edge and in seriatim in a direction of document feed motion that is disposed substantially in the plane of said documents;

a revolvable hollow helix device adapted for receiving said on-edge documents between the turns of said helix, said helix device having an axis disposed substantially orthogonally to the plane of said documents being received by said helix device;

drive means for revolving said helix device about said axis;

clutch means for intermittently connecting said drive means to said helix device;

control means for controlling intermittent engagement of said clutch means;

sensing means for sensing when each one of said documents is being received by said helix device and for providing signals to said control means to indicate the entry of a document into said helix;

said control means being operative in response to receipt of said signal to cause said clutch to engage said drive means to rotate said helix one revolution and disengage said drive means thereafter;

a stack-accumulating raceway; and, stop means disposed on the opposite side of said axis relative to the side from which said documents are received by said helix device, said stop means being in a position to be struck by said documents that are being received by said helix device, and wherein rotation of said helix device transports said documents, whose said feed motion has been stopped by said stop means, onto said stack-accumulating raceway.

2. Mailing machine apparatus in accordance with claim 1, wherein said helix device has non-uniform leads so that spacing between consecutive coils becomes smaller toward the end of said helix device that faces said stack-accumulating raceway.

3. Mailing machine apparatus in accordance with claim 1, wherein said means for feeding documents includes means for assisting stacking of said documents.

4. Mailing machine apparatus according to claim 3, wherein said means for assisting stacking comprises a feed belt moving in the direction of stacking along a lateral edge of said documents being stacked, said feed belt resiliently engaging said lateral edge in a partially-sliding manner.

5. Mailing machine apparatus in accordance with claim 1, including at least one anti-rotation stop that is adjustably disposed in the region of said abutment stop means to ensure that said documents being received and transported by said helix device are prevented from rotating with said helix device, said anti-rotation stop being adjustable to be effective over a range of sizes of said documents.

6. Mailing machine apparatus in accordance with claim 1, wherein said means for feeding documents includes entry sensor means for sensing entry of documents into said means for feeding documents, said entry sensor means, in conjunction with said sensing means and said control means, facilitating malfunction and jam detection in and automatic shut-down of said means for feeding documents.

7. Mailing machine apparatus in accordance with claim 1, wherein relative locations of at least one of said means for feeding documents, said helix device, said abutment stop means, and said stack-accumulating raceway is adjustable so that said apparatus is capable of being adjusted to handle different sizes of said documents.

* * * * *